US010436519B1

(12) United States Patent
Longtin

(10) Patent No.: US 10,436,519 B1
(45) Date of Patent: Oct. 8, 2019

(54) COCURRENT LOOP THERMOSYPHON HEAT TRANSFER SYSTEM FOR SUB-AMBIENT EVAPORATIVE COOLING AND COOL STORAGE

(71) Applicant: The Research Foundation for The State University of New York, Albany, NY (US)

(72) Inventor: Jon P. Longtin, Port Jefferson, NY (US)

(73) Assignee: The Research Foundation for The State University of New York, Albany, NY (US)

( * ) Notice: Subject to any disclaimer, the term of this patent is extended or adjusted under 35 U.S.C. 154(b) by 119 days.

(21) Appl. No.: 15/293,723

(22) Filed: Oct. 14, 2016

Related U.S. Application Data

(60) Provisional application No. 62/241,364, filed on Oct. 14, 2015.

(51) Int. Cl.
*F28D 15/02* (2006.01)
*F28D 15/06* (2006.01)

(52) U.S. Cl.
CPC ..... *F28D 15/0266* (2013.01); *F28D 15/025* (2013.01); *F28D 15/06* (2013.01); *F28D 2015/0291* (2013.01)

(58) Field of Classification Search
CPC ... H01L 23/427; F28D 15/0266; F28D 15/04; F28D 15/043; F28D 15/06; F28D 2015/0291; F28D 15/025
USPC ..... 165/104.22, 104.25, 104.33, 104.28, 165/104.31, 272, 104.21
See application file for complete search history.

(56) References Cited

U.S. PATENT DOCUMENTS 4,230,173 A * 10/1980 Eastman ..... F28D 15/0266 165/104.25
4,492,266 A * 1/1985 Bizzell ..... F28D 15/043 122/366
4,903,761 A * 2/1990 Cima ..... F28D 15/043 122/366
5,333,677 A * 8/1994 Molivadas ..... F03G 6/003 123/41.21
5,857,355 A * 1/1999 Hwang ..... F25B 15/04 62/476
8,651,172 B2 * 2/2014 Wyatt ..... F25B 23/006 165/104.21

(Continued)

FOREIGN PATENT DOCUMENTS

WO WO-2014125064 A1 * 8/2014 ..... F28D 15/025

*Primary Examiner* — Devon Russell
(74) *Attorney, Agent, or Firm* — The Farrell Law Firm, P.C.; John F. Gallagher, III

(57) ABSTRACT

Provided is a cocurrent loop thermosyphon system and method for operation thereof. The system includes a first rising tube having first and second ends; a condenser having first and second ends, with the first end connected to the second end of the first rising tube; a return tube having a first end connected to the second end of the condenser; a second rising tube having a first end connected to a second end of the return tube; a pump that pumps liquid within the second rising tube; and an evaporator having a first end connected to the second end of the second rising tube. The second end of the evaporator outputs vapor created by a change in state of the liquid to the first end of the first rising tube.

18 Claims, 5 Drawing Sheets

(56) References Cited

U.S. PATENT DOCUMENTS

| | | | | |
|---|---|---|---|---|
| 2009/0114374 | A1* | 5/2009 | Ohta | F28D 15/02 165/104.21 |
| 2010/0032150 | A1* | 2/2010 | Determan | F28D 15/0266 165/246 |
| 2011/0162821 | A1* | 7/2011 | Manzer | F28D 15/0266 165/104.31 |
| 2012/0324911 | A1* | 12/2012 | Shedd | F25B 25/00 62/62 |
| 2013/0286591 | A1* | 10/2013 | Myers | H05K 7/20927 361/700 |

* cited by examiner

COCURRENT LOOP THERMOSYPHON HEAT TRANSFER SYSTEM FOR SUB-AMBIENT EVAPORATIVE COOLING AND COOL STORAGE

PRIORITY

This application claims priority to U.S. Provisional Application No. 62/241,364, filed with the U.S. Patent and Trademark Office on Oct. 14, 2015, the content of which is incorporated herein by reference.

GOVERNMENT SUPPORT

This invention was made with government support under grant number DE-AR0000575 awarded by the Department of Energy. The government has certain rights in the invention.

BACKGROUND OF THE INVENTION

1. Field of the Invention

The present invention relates generally to a heat exchanger and a method of operating same.

2. Description of the Background Art

U.S. electricity is typically produced in thermoelectric power generating plants using coal, natural gas, or nuclear power to input energy to generate thermal energy to drive steam turbines. Use of steam turbines causes approximately 60% of input energy to be wasted as low-grade heat.

Thermosyphons have been used to cool systems having a high heat flux by vaporizing a working liquid housed within an evaporator section to absorb heat. Thermosyphons have been used in energy recovery for buildings, industrial processes, and the Alaskan pipeline [1-6]. A simple closed two-phase thermosyphon consists of a vertical evacuated tube with the working liquid. Heat is added at the bottom of the thermosyphon, vaporizing the liquid. The vapor flows to the top, where heat is removed and the liquid condenses. Liquid condensate returns by gravity back to the bottom, i.e., evaporator, region of the thermosyphon.

FIG. 1 is a cut-away profile view of a conventional thermosyphon heat exchanger 100 that includes an evaporator section 120, an adiabatic section 150, and a condenser section 170. The thermosyphon heat exchanger 100 has an internal cavity 110 that traverses each of the evaporator section 120, the adiabatic section 150 and the condenser section 170, with the internal cavity 110 being sealed from an external environment. The evaporator section 120 and the condenser section 170 are on opposite ends of the adiabatic section 150. As shown in FIG. 1, liquid pool 114 is provided at a bottom end of the evaporator section 120. When liquid from the liquid pool 114 evaporates, i.e., is boiled or vaporized, the vapor moves upward from the evaporator section 120 through an interior of the sealed internal cavity 110 following an upward path of vapor flow 130 to the condenser section 170. In the condenser section 170, heat is ejected and the vapor returns to the liquid state, with the liquefied vapor returning to the liquid pool 114 along a downward path of liquid flow 190. Flow of vapor upward along the inner path and flow of liquid downward along the outer path is a counter-current flow of a conventional thermosyphon, which provides an extremely low-resistance path to heat transfer since the latent heat of phase change is used as the energy transfer mechanism. The liquid and vapor flows are countercurrent, as they move in opposite directions.

Hydrodynamics of falling films and their evaporation heat transfer have been extensively studied [7-20]. Nusselt's [7] parabolic velocity profile solution for smooth laminar falling films is the earliest significant contribution to this area. Chun and Seban [8] proposed correlations for water film evaporation on vertical tubes at atmospheric and vacuum conditions. The film Reynolds number, $Re=4\Gamma/\mu$, where $\Gamma$ is the mass flow rate per unit film width and $\mu$ is the liquid viscosity, determines the nature of the film flow. A falling film consists of a base film with waves on the top, whose structure can be complex. For water films near room temperature, sinusoidal waves with both long and short amplitudes develop along the free interface at $10<Re<30$. When $Re>30$, the waves become irregular. At $Re\sim1{,}000$ the film flow becomes turbulent [19]. The enhancement of heat transfer in wavy laminar flow is due to the roll waves, which induce circulating flow in the film's bulk [11-13]. In turbulent films, mixing by eddies is believed to be the dominant mechanism of enhancing heat transfer.

Although conventional thermosyphons effectively dissipate heat, systems utilizing conventional thermosyphons are subject to shortcomings that include limitations of dry out, entrainment, and liquid pool expansion. The dry out limit occurs when excess heat is added to the thermosyphon, causing dry patches to form in the evaporator when insufficient extra liquid is available and the liquid returning from the condenser cannot replenish the liquid pool [21-24]. Entrainment, i.e., flooding, occurs when a shear stress develops at the liquid-vapor interface opposite to the direction of normal downward liquid flow in. At higher heat inputs, the increased vapor velocity can result in a shear stress on the surface that causes liquid to tear away and become entrained in the vapor stream, causing condensate to be unable to return to the evaporator, resulting in a maximum heat input limitation, often being the constraining limit on maximum heat transfer through a thermosyphon [21-24]. Most thermosyphon applications include a liquid pool that serves as a liquid reserve to accommodate varying heat input to the device. At high heat inputs, boiling within the liquid pool can cause the pool to expand in the evaporator, up to the condenser, severely reducing performance [22, 23].

SUMMARY OF THE INVENTION

To avoid the above shortcomings of conventional systems and methods, the present invention provides a device with cocurrent, i.e., unidirectional, flow that overcomes dry out, entrainment and liquid pool expansion concerns of conventional systems.

Aspects of the present disclosure provide a cocurrent loop thermosyphon system that includes a first rising tube having a first end and a second end on opposite ends thereof; a condenser having a first end and a second end on opposite ends thereof, with the first end connected to the second end of the first rising tube; a return tube having a first end connected to the second end of the condenser; a second rising tube having a first end connected to a second end of the return tube; a pump configured to pump liquid within the second rising tube; and an evaporator having a first end connected to the second end of the second rising tube, with a second end of the evaporator outputting vapor created by a change in state of the liquid to the first end of the first rising tube.

BRIEF DESCRIPTION OF THE DRAWINGS

The above and other objects, features and advantages of certain exemplary embodiments of the present disclosure will be more apparent from the following detailed description taken in conjunction with the accompanying drawings, in which.

DETAILED DESCRIPTION OF THE PREFERRED EMBODIMENTS

The following detailed description of preferred embodiments of the disclosure will be made in reference to the accompanying drawings. In describing the disclosure, an explanation about related functions or constructions known in the art are omitted for the sake of clearness in understanding the concept of the disclosure, and to avoid obscuring the disclosure with unnecessary detail.

A thermosyphon is provided with cocurrent loop vapor-liquid flow, i.e., flow in the same direction in both the evaporator and condenser, rather than the counter-current flow of conventional systems, thereby removing flooding limit while producing a thinner evaporating film, and improving performance utilizing a liquid that includes standard plant feed water and municipal makeup water.

Figure 1:
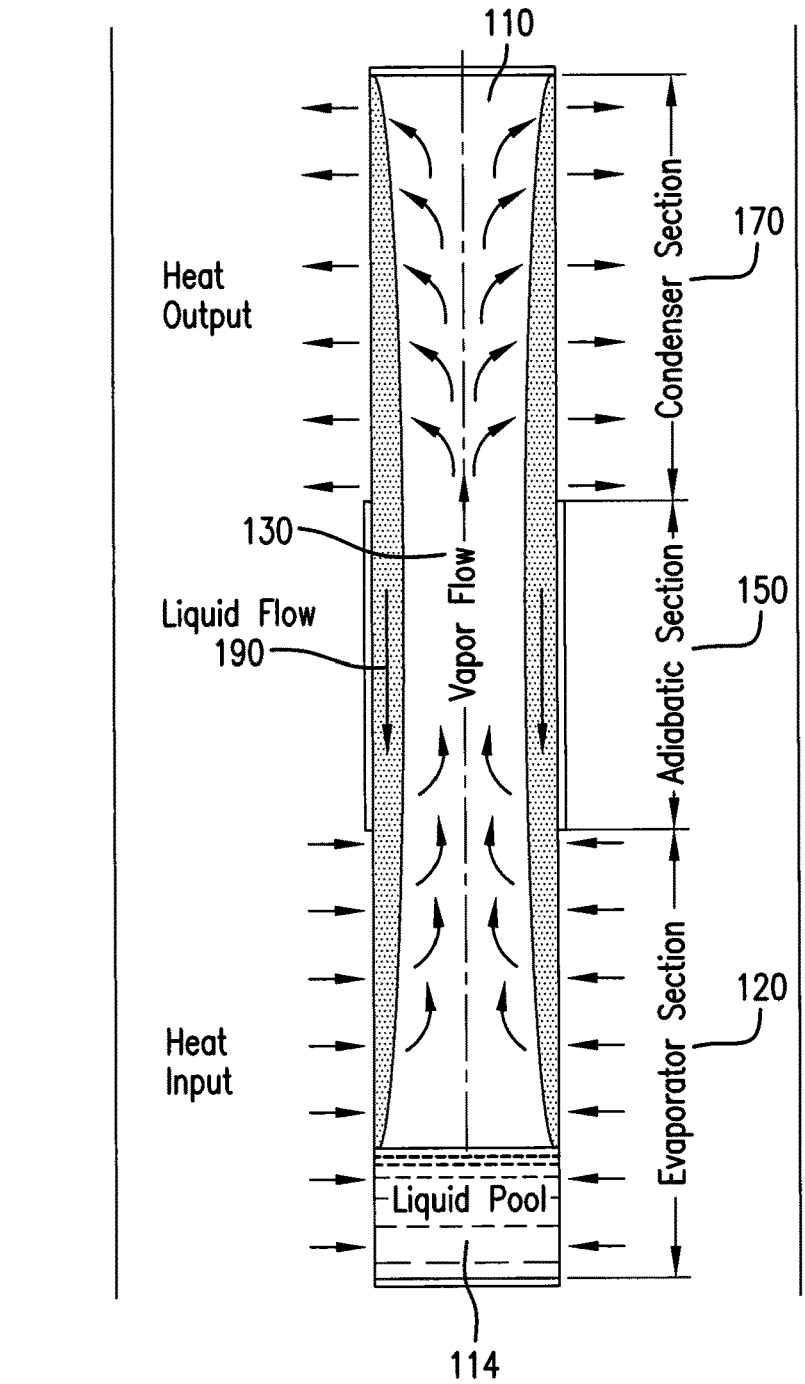
FIG. 1 PRIOR ART
FIG. 1 illustrates a conventional counter-current thermosyphon.
Figure 2:
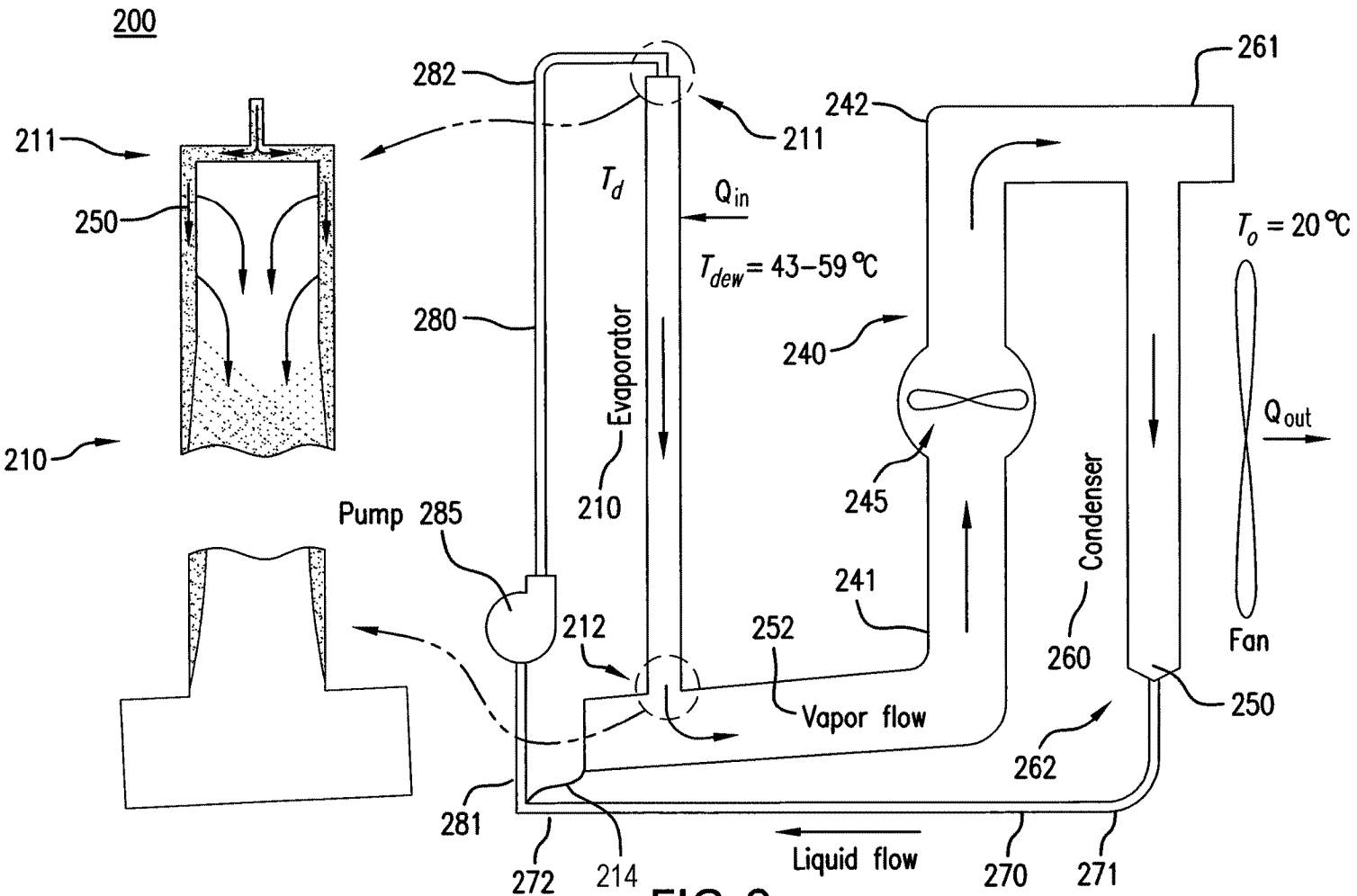
FIG. 2 illustrates a cocurrent thermosyphon according to an embodiment of the present disclosure.

FIG. 2 illustrates a thermosyphon according to an embodiment of the present disclosure.

As shown in FIG. 2, liquid 250 is delivered to an upper end of evaporator 210 by pump 285, which drives flow of liquid 250 upward in a second rising tube 280. Upon reaching the upper end of evaporator 210, liquid 250 absorbs ambient energy and vaporizes, with vapor 252 being output from a lower end of evaporator 210, which discharges the vapor 252 to first rising tube 240.

Blower 245 is provided within the first rising tube 240 to increase lift between the evaporator 210 and condenser 260, thereby improving performance of thermosyphon 200. Blower 245 is a centrifugal blower that operates in near-vacuum conditions as a low-lift, on-demand, variable-speed blower. Blower 245 preferably operates at a 4-6 kPa absolute nominal working pressure, a pressure ratio<2.0, and 500 CFM to provide an increase in condensate capture rates of at least 70% by blower 245 operation. Parameters of blower selection are provided in Table 1.

TABLE 1

| Parameter | Requirement |
|---|---|
| Working fluid | Water vapor |
| Volumetric flow | 14 $m^3$/min (500 CFM) |
| Temperature range | 30-40 C. (86-104 F.) |
| Pressure range | 4.5-7 kPa (0.65-1 psia) |
| Pressure rise | 7 kPa (30" $H_2O$) |

In conventional thermosyphons, the vapor pressure drop in moving from the evaporator to the condenser is small. As a result, the vapor saturation temperature in the evaporator, $T_e$, and the condenser, To, are nearly equal, $T_e \cong T_c$. In contrast, operation of blower 245 reduces temperature of evaporator 210 and increases temperature of condenser 260, thereby increasing heat flow and condensate rate of thermosyphon 200. In regards to thermal transfer, condenser 260, which has only dry air available for heat rejection, can be made significantly larger in area than evaporator 210, reducing the heat flux, and thus the thermal performance demands on the condenser fins [26].

The absolute pressure rise is of an order of 5 kPa, while heat transfer for blower work can be high, e.g., 30+. Table 2 provides cost-benefit blower parameters, based on blower pressure ratios of 1.2, 1.3, 1.5, 1.7, and 2.0, with 2.0 being a practical upper limit on a realizable pressure difference.

TABLE 2

| Parameter | Value |
|---|---|
| Flue gas temperature, $T_{fg}$ | 45° C. |
| Ambient air temperature, $T_a$ | 15° C. |
| Length of evaporator, $L_e$ | 14 m (45.9 ft) |
| Evaporator tube diameter, $D_e$ | 0.254 m (10 in) |
| Number of evaporator tubes (finned), $N_{tube}$ | 1,500 |

Figure 3:
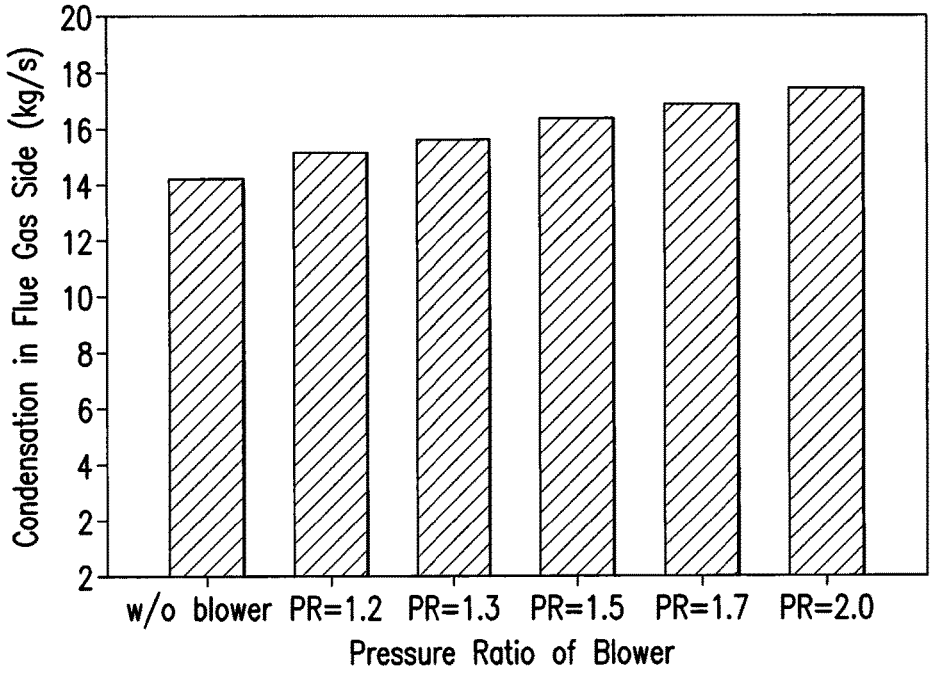
FIG. 3 is a graph of overall condensation rate as a function of blower pressure ratio according to the present disclosure.

The overall condensation rate as a function of blower pressure ratio is shown in FIG. 3, which is a graph of overall condensation rate as a function of blower pressure ratio according to the present disclosure.

The condensation rate increases with blower pressure ratio, though there is an electricity penalty required to drive blower 245, with electricity usage increasing with increased pressure ratio. Table 3 provides estimated electricity consumption for blower operation, assuming a high-efficiency (96%) variable-frequency drive motor for the blower.

TABLE 3

| | Pressure Ratio | | | | | |
|---|---|---|---|---|---|---|
| | w/o | 1.2 | 1.3 | 1.5 | 1.7 | 2.0 |
| Total heat Removed (MW) | 41.1 | 44.2 | 45.6 | 48.2 | 49.8 | 52.0 |
| Condensation rate (kg/s) | 14.2 | 15.2 | 15.6 | 16.4 | 16.8 | 17.4 |
| Condensation Rate (% increase) | — | 7.0% | 9.9% | 15.5% | 18.3% | 22.5% |
| Total blower work (MWe)* | — | 0.70 | 1.04 | 1.77 | 2.28 | 3.08 |

Accordingly, blower 245 is preferably run at full power only when maximum cooling is needed and otherwise runs at partial load to provide an intermediate cooling benefit at a reduced energy cost. When lift is not needed, the centrifugal design of blower 245 causes minimal vapor pressure drop when blower 245 does not operate.

At an upper end of first rising tube 240, vapor 252 is output to an upper end of condenser 260. While traveling downward through condenser 260, vapor 252 changes state to liquid 250, and is collected for return via return tube 270 to a lower end of second rising tube 280.

As shown in FIG. 2, a cocurrent loop thermosyphon system 200 is provided that includes a first rising tube 240 having a first end 241 and a second end 242 on opposite ends of the first rising tube 240. A blower 245 is provided between the first end 241 and the second end 242 of the first rising tube 240. A condenser 260 is provided having a first end 261 and a second end 262 on opposite ends thereof, with the first end 261 of the condenser 260 connected to the second end 242 of the first rising tube 240. A return tube 270 has a first end 271 connected to the second end 262 of the condenser 260. A second rising tube 280 has a first end 281 connected to a second end 272 of the return tube 270. A pump 285 pumps liquid within the second rising tube 280, and evaporator 210 has a first end 211 connected to a second end 282 of the second rising tube 280. A second end 212 of the evaporator 210 outputs vapor created by a change in state of the fluid to the first end 241 of the first rising tube 240, and the blower 245 increases lift.

As illustrated in the cutaway view provided on the left side of FIG. 2, an active working fluid distribution system is provided that a film of liquid 250 exists only on walls of the evaporator 210, with the film of the liquid 250 being thicker near the first end 211 of the evaporator 210 than at the second end 212 of the evaporator 210. Also see FIG. 4. Excess fluid that does not evaporate accumulates at the second end 212 of the evaporator 210 and flows to the first end 281 of the second rising tube 280 via drain line 214. In contrast, as described above, conventional systems include a liquid pool and therefore suffer associated low performance and related limiting issues. The thermosyphon 200 eliminates these limitations associated with conventional liquid pools.

Figure 4:
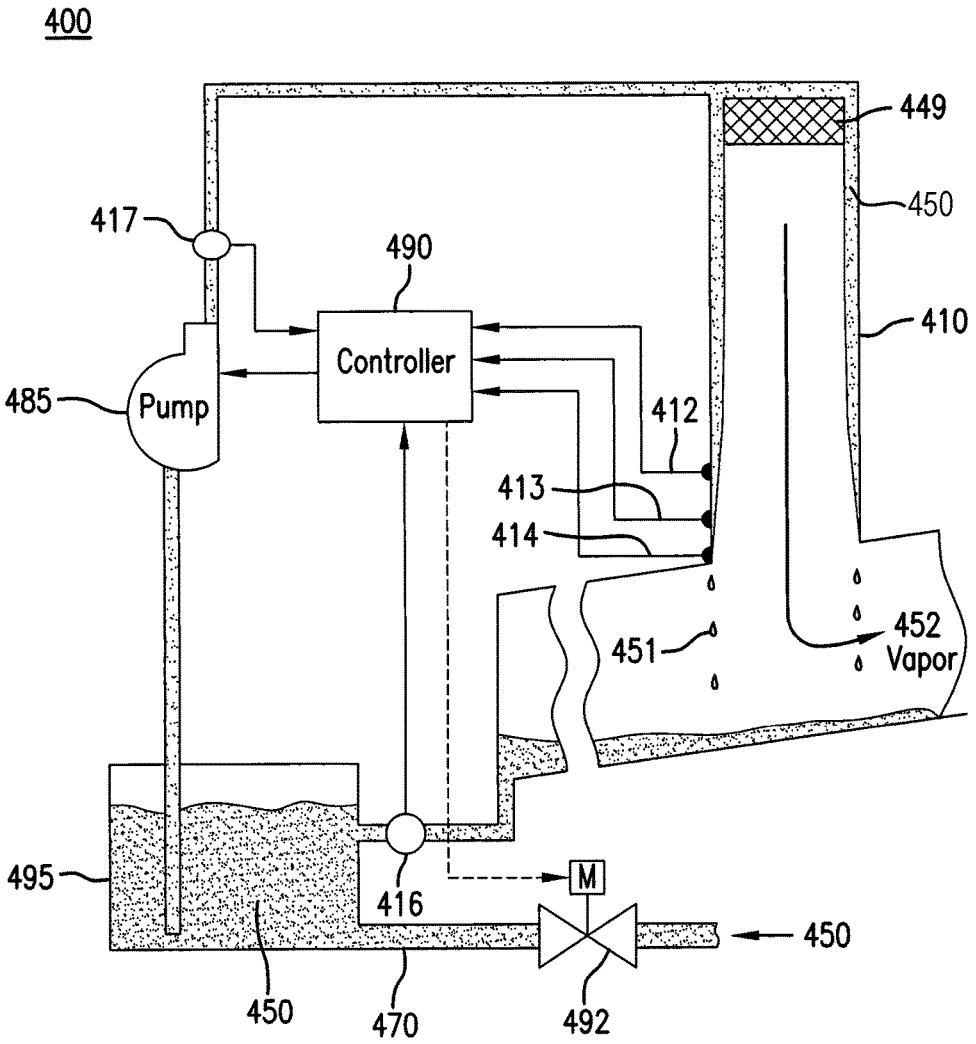
FIG. 4 illustrates a cocurrent thermosyphon according to an embodiment of the present disclosure.

FIG. 4 illustrates a thermosyphon according to another embodiment of the present disclosure.

In FIG. 4, controller 490 of thermosyphon 400 receives input from temperature sensors 412-414, and increases a rate of flow of liquid 450 to provide additional liquid for evaporation in evaporator 410. As higher temperatures are received from temperature sensors 412-414, controller 490 increases the supply of liquid, to increase the film Reynolds number and transition the film to turbulence, thereby increasing heat transfer rate in evaporator 410.

Controller 490 provides an actively controlled working liquid distribution system of thermosyphon 400, which includes liquid reservoir 495, from which working liquid 450 is delivered in the liquid state to a spreading grid 449 at the top of the evaporator 410 by pump 485, to produce a falling liquid film along interior walls of evaporator 410. The falling liquid 450 film evaporates into vapor 452 as flue gas condenses on the outer wall of the evaporator 410.

Controller 490 controls pump 485 to provide sufficient liquid to a top, i.e., first end of evaporator 410 so that, as the liquid evaporates, the liquid film ends at the bottom, i.e., second end, wall of the evaporator 410. Insufficient liquid will cause dry out at the bottom of the inner wall of evaporator 410, resulting in increased temperature, which is sensed by temperature sensor 414 positioned at the bottom of the wall of evaporator 410. Temperature sensor 414 also detects flow of any excess liquid that is not evaporated, e.g., rivulets 451. Flow meter 416 also detects flow of falling liquid that does not change state into vapor and does not proceed to the rising tube and blower. In the embodiment shown in FIG. 4, the falling liquid that does not change state into vapor flows into liquid reservoir 495.

Controller 490 receives input from temperature sensors 412-414, first flow meter 416 and second flow meter 417, which monitors output of pump 485. Temperature sensors 412-414 monitor temperature along a length of the second end of evaporator 410. Controller 490 continuously monitors operating conditions of thermosyphon 400 and adjusts the flow rate as needed. Controller 490 also operates an flow control valve 492 to variably throttle flow in return tube 470 of liquid 450 returning from condenser.

As an alternative to providing sufficient liquid so that the evaporating liquid film ends at the bottom of the evaporator 410, controller 490 controls pump 485 to provide additional liquid to cause excess liquid, i.e., rivulets 451, to fall from the bottom of the evaporator 410, i.e., a second end of the evaporator 410. The rivulets 451 provide a thicker liquid film, which creates turbulent flow and enhances heat transfer, akin to falling film evaporators used in chemical engineering applications [26, 27], seawater desalination [28-30], and food industry applications [31, 32].

A critical film thickness, $\delta_c$, is a minimum thickness below which the film will start to form rivulets is provided by Equation (1):

$$\delta_c = \Delta\left(\frac{15\mu_l^2\sigma_{LV}}{\rho_l^3 g^2}\right)^{0.2} \tag{1}$$

where μ, σ, p and g represent the liquid dynamic viscosity, surface tension, density, and gravity, respectively, and Δ is related to the contact angle, $\theta_0$, formed between the liquid and wall material, provided by Equation (2):

$$\Delta = \left(\frac{3}{2}\right)^{\frac{1}{5}}(1-\cos\theta_0)^{1/5} \tag{2}$$

The critical thickness and relevant parameters for several working liquids are shown in Table 4, which shows that water has the largest critical thickness, while R134a has the lowest.

TABLE 4

Pure Substance (at 35 deg C.) With copper tube surface

| | Water | Propanol | Ethanol | Methanol | R134a |
|---|---|---|---|---|---|
| contact angle $\theta_0$ | 86 | 15 | 15 | 25 | 6 |
| surface tension $\sigma_{LV}$ (mN/m) | 70.35 | 22.51 | 20.47 | 70.35 | 67.2 |
| Viscosity $\mu_l$ (mPa s) | 0.7 | 1.959 | 0.899 | 0.47 | 0.171 |
| Delta Δ | 1.07 | 0.52 | 0.55 | 0.68 | 0.383 |
| critical thickness (mm) | 0.380 | 0.251 | 0.194 | 0.186 | 0.044 |

In the evaporator of the thermosyphon of the present disclosure, the film is thickest at the top, where the water 450 is provided. The film gets thinner moving down the inside of the thermosyphon due to evaporation of the water. Thus, a minimum water flow rate can be established that ensures the film thickness at the bottom of the tube will be ≅δ.

Figure 5:
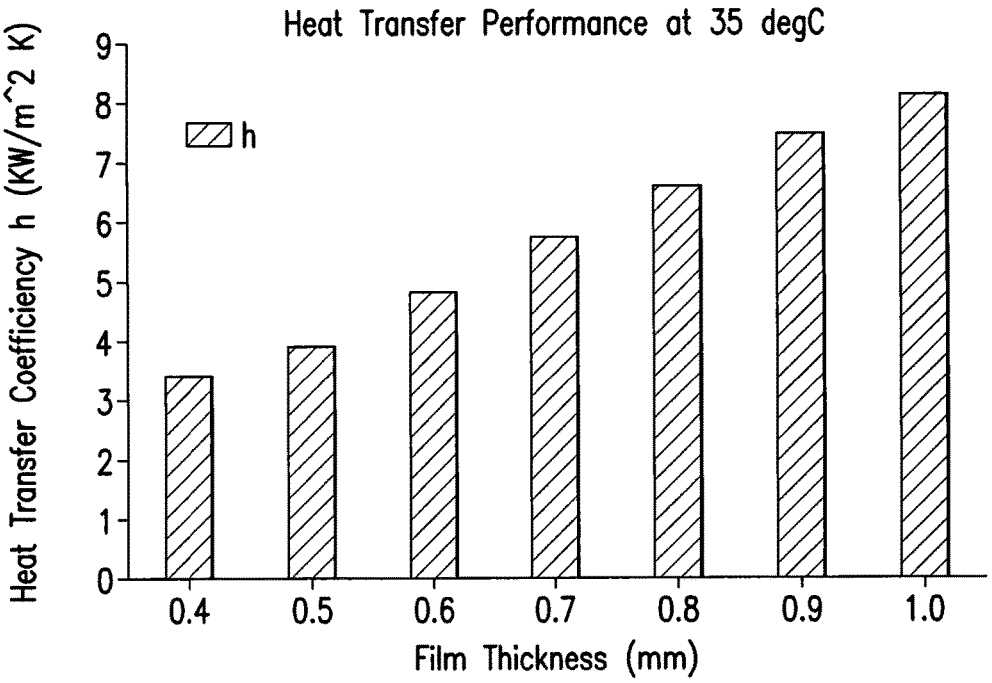
FIG. 5 is a graph of heat transfer coefficient versus average film thickness on the wall of the condenser of the thermosyphon according to the present disclosure.

FIG. 5 is a graph of heat transfer coefficient, h, versus average film thickness on the wall of the condenser of the thermosyphon.

In regards to increasing the film thickness beyond 8c, as shown in FIG. 5, increasing the water mass flow rate that flows over the evaporator walls increases the heat transfer, or, equivalently, decreases the thermal resistance. At first glance, the implication might be to maximize the water flow rate in the system to obtain a film as thick as possible. However, an increased film thickness requires a larger water mass flow rate, which increases pumping costs. Despite the threefold increase in heat transfer in the thermosyphon, the limiting thermal resistances reside elsewhere in the thermosyphon, hence in practice large changes in h can limit improvement in overall heat transfer through the system.

The co-current flow of the thermosyphons of the present invention eliminates the conventional liquid pool and associated performance issues.

Also, the thermosyphon may be built in modules, with a first module for removing a first part of the flue gas water vapor, without operation of the low-lift blower. Further downstream, as more water is extracted, the blower operates to optimize performance.

Also, condensing flue gas has been utilized for water recovery to improve efficiency and reduce emissions [33-35]. Conventional systems do not collect and use water from flue gas for cool storage, which provides significant advantages for cool storage, which provides benefits described in Table 5. In the present disclosure, water from flue gas for cool storage is stored in bladder tanks or pillow tanks.

TABLE 5

| Parameter | Value | Description |
|---|---|---|
| Storage Density | Very High | Latent heat per unit mass is much greater than sensible heat |
| Storage Time | Excellent | Sensible heat storage can degrade by heat loss over time. Latent heat can be kept indefinitely without loss of capacity |
| Capacity Scalability | Straightforward | If additional storage is desired, one need only add inexpensive water storage tanks |
| Environmental Impact | Benign | Water is non-toxic, environmentally benign, and safe to handle (though flue gas condensate may be acidic and have dissolved material) |
| Retrieval Temperature | Constant | Unlike sensible storage, in which the temperature increases as heat is added, latent heat provides a constant retrieval temperature |
| Charging Time | 24 hr./day | Flue gas condensate can be collected continuously throughout the day and night; there is no restriction to night-time operation |

The present disclosure provides an improved storage density, with latent heat per unit mass being much greater than sensible heat. Latent heat providing a more efficient means of cool storage on a per-volume basis than sensible heat. That is, condensing water from flue gas is accomplished using a two-phase loop thermosyphon as described above. Because the two-phase loop thermosyphon uses phase change, heat transfer occurs with a very low thermal resistance, and ambient conditions provide the heat removal to condense water vapor in the flue gas without additional refrigeration equipment.

While the invention has been shown and described with reference to certain exemplary embodiments of the present disclosure thereof, it will be understood by those skilled in the art that various changes in from and details may be made therein without departing from the spirit and scope of the present invention as defined by the appended claims and equivalent thereof.

REFERENCES

1. Yau, Y. H., Application of a heat pipe heat exchanger to dehumidification enhancement in a HVAC system for tropical climates—a baseline performance characteristics study. International Journal of Thermal Sciences, 2007. 46(2): p. 164-171.
2. Jouhara, H. and R. Meskimmon, Heat pipe based thermal management systems for energy-efficient data centres. Energy, 2014. 77: p. 265-270.
3. Lukitobudi, A., et al., Design, construction and testing of a thermosyphon heat exchanger for medium temperature heat recovery in bakeries. Heat Recovery Systems and CHP, 1995. 15(5): p. 481-491.
4. Xiao Ping, W., P. Johnson, and A. Akbarzadeh, Application of heat pipe heat exchangers to humidity control in air-conditioning systems. Applied Thermal Engineering, 1997. 17(6): p. 561-568.
5. Singh, R., et al., Heat pipe based cold energy storage systems for datacenter energy conservation. Energy, 2011. 36(5): p. 2802-2811.
6. Zarling, J. and F. Haynes. Thermosiphon-based designs and applications for foundations built on permafrost. in International Arctic Technology Conference. 1991. Society of Petroleum Engineers.
7. Nusselt, W., Die oberflächenkondensation des Wasserdampfes Z. VDI, 1961: p. 541.
8. Chun, K. R. and R. A. Seban, Heat Transfer to Evaporating Liquid Films. Journal of Heat Transfer, 1971. 93(4): p. 391-396.
9. Chun, K. R. and R. A. Seban, Performance Prediction of Falling-Film Evaporators. Journal of Heat Transfer, 1972. 94(4): p. 432-436.
10. Kapitsa, P. L., Collected papers of P L Kapitsa. 1964.
11. Telles, A. and A. Dukler, Statistical characteristics of thin, vertical, wavy, liquid films. Industrial & Engineering Chemistry Fundamentals, 1970. 9(3): p. 412-421.
12. Chu, K. and A. Dukler, Statistical characteristics of thin, wavy films: Part II. Studies of the substrate and its wave structure. AIChE Journal, 1974. 20(4): p. 695-706.
13. Chu, K. and A. Dukler, Statistical characteristics of thin, wavy films III. Structure of the large waves and their resistance to gas flow. AIChE Journal, 1975. 21(3): p. 583-593.
14. Wasden, F. K. and A. Dukler, A numerical study of mass transfer in free falling wavy films. AIChE Journal, 1990. 36(9): p. 1379-1390.
15. Hubbard, G., A. Mills, and D. Chung, Heat transfer across a turbulent falling film with cocurrent vapor flow. Journal of Heat Transfer, 1976. 98(2): p. 319-320.
16. Mills, A. and D. Chung, Heat transfer across turbulent falling films. International Journal of Heat and Mass Transfer, 1973. 16(3): p. 694-696.
17. Mudawwar, I. and M. El-Masri, Momentum and heat transfer across freely-falling turbulent liquid films. International journal of multiphase flow, 1986. 12(5): p. 771-790.
18. Seban, R. and A. Faghri, Evaporation and heating with turbulent falling liquid films. Journal of Heat Transfer, 1976. 98(2): p. 315-318.
19. Abdulmalik A. Alhusseini Heat and mass transfer in falling film evaporation of viscous liquids. 1995, Lehigh University.
20. Alhusseini, A. A., K. Tuzla, and J. C. Chen, Falling film evaporation of single component liquids. International Journal of Heat and Mass Transfer, 1998. 41(12): p. 1623-1632.
21. Park, Y. J., H. K. Kang, and C. J. Kim, Heat transfer characteristics of a two-phase closed thermosyphon to the fill charge ratio. International Journal of Heat and Mass Transfer, 2002. 45(23): p. 4655-4661.

22. El-Genk, M. S. and H. H. Saber, Determination of operation envelopes for closed, two-phase thermosyphons. International Journal of Heat and Mass Transfer, 1999. 42(5): p. 889-903.
23. Jiao, B., et al., Investigation on the effect of filling ratio on the steady-state heat transfer performance of a vertical two-phase closed thermosyphon. Applied Thermal Engineering, 2008. 28(11-12): p. 1417-1426.
24. Reed, J. G. and C. L. Tien, Modeling of the Two-Phase Closed Thermosyphon. Journal of Heat Transfer, 1987. 109(3): p. 722-730.
25. Garrity, P. T., J. F. Klausner, and R. W. Mei, Performance of Aluminum and Carbon Foams for Air Side Heat Transfer Augmentation. Journal of Heat Transfer-Transactions of the Asme, 2010. 132(12).
26. Green, D. W., Perry's chemical engineers' handbook. Vol. 796. 2008: McGraw-hill New York.
27. Hewitt, G. F., G. L. Shires, and T. R. Bott, Process heat transfer. 1994.
28. El-Dessouky, H., et al., Steady-state analysis of the multiple effect evaporation desalination process. Chemical engineering & technology, 1998. 21(5): p. 437.
29. Yang, L. and S. Shen, Experimental study of falling film evaporation heat transfer outside horizontal tubes. Desalination, 2008. 220(1): p. 654-660.
30. Bourouni, K., et al., Heat transfer and evaporation in geothermal desalination units. Applied Energy, 1999. 64(1-4): p. 129-147.
31. Chen, H. and R. Jebson, Factors affecting heat transfer in falling film evaporators. Food and Bioproducts Processing, 1997. 75(2): p. 111-116.
32. Gourdon, M., et al., Qualitative investigation of the flow behaviour during falling film evaporation of a dairy product. Experimental Thermal and Fluid Science, 2015. 60: p. 9-19.
33. Jeong, K., et al., Analytical modeling of water condensation in condensing heat exchanger. International Journal of Heat and Mass Transfer, 2010. 53(11-12): p. 2361-2368.
34. Levy, E., et al., Heat Exchangers for Cooling Boiler Flue Gas to Temperatures below the Water Vapor Dewpoint, in ASME 2011 Power Conference. 2011, ASME: Denver, Colo. p. 393-399.
35. Kessen, M. J., Optimal Design of an Air-Cooled Condenser for Flue Gas from a Power Plant, in Mechanical Engineering. 2012, Lehigh University.

What is claimed is:

1. A cocurrent loop thermosyphon system comprising:

a first rising tube having a first end and a second end on opposite ends of the first rising tube, wherein the second end of the first rising tube is at a higher elevation than the first end of the first rising tube;

a condenser having a first end and a second end on opposite ends thereof, with the first end of the condenser fluidically connected to the second end of the first rising tube, wherein the first end of the condenser is at a higher elevation than the second end of the condenser;

a return tube having a first end fluidically connected to the second end of the condenser;

a second rising tube having a first end and a second end, with the first end of the second rising tube being fluidically connected to a second end of the return tube, wherein the second end of the second rising tube is at a higher elevation than the first end of the second rising tube;

a pump configured to pump liquid from the first end of the second rising tube to the second end of the second rising tube; and a substantially vertical evaporator having a first end and a second end, with the first end of the evaporator fluidically connected to the second end of the second rising tube, wherein the first end of the evaporator is at a higher elevation than the second end of the evaporator, and wherein the second end of the evaporator is configured to output vapor created by a change in state of the liquid to the first end of the first rising tube.

2. The system of claim 1, wherein the pump is configured to increase pressure of the liquid traveling upward within the second rising tube.

3. The system of claim 1, wherein the pump is positioned between the first end of the second rising tube and the second end of the second rising tube, and the pump actively meters an amount of the liquid delivered to the first end of the evaporator.

4. The system of claim 1, further comprising a temperature sensor configured to detect temperature at the second end of the evaporator.

5. The system of claim 4, further comprising a controller configured to control a flow control valve in the return tube, based on temperature detected by the temperature sensor.

6. The system of claim 1, further comprising a controller configured to control the pump to preclude flow of liquid from the second end of the evaporator, while providing a film of the liquid along an inner wall of the evaporator.

7. The system of claim 1, further comprising a controller configured to control the pump to expel liquid from the second end of the second rising tube when necessary to provide a film of the liquid along an inner wall of the evaporator.

8. The system of claim 1, wherein the system is a closed loop system that operates without a liquid pool at a bottom end of the evaporator.

9. The system of claim 1, further comprising a blower provided between the first end and the second end of the first rising tube.

10. The system of claim 9, wherein the blower is enclosed within the first rising tube.

11. The system of claim 9, wherein the blower is configured to increase a pressure differential between the evaporator and the condenser.

12. The system of claim 9, wherein the blower is a centrifugal, low-lift blower configured to modify pressure of vapor in the first rising tube.

13. The system of claim 4, further comprising a controller configured to control a blower, based on temperature detected by the temperature sensor.

14. A method for operation of a cocurrent loop thermosyphon system, the method comprising:

cooling, by a substantially vertical condenser, a vapor into a liquid, wherein the liquid flows into a return tube fluidically connected on one end to the condenser and fluidically connected on another end to a first rising tube;

pumping, by a pump, the liquid in the first rising tube to a substantially vertical evaporator having a first end and a second end, wherein the first end of the evaporator is at a higher elevation than the second end of the evaporator, and the first of the evaporator is fluidically connected to a second end of the first rising tube;

heating, by the evaporator, the liquid into the vapor; and outputting the vapor from the evaporator to a second rising tube, wherein the second end of the evaporator is configured to output vapor created by a change in state of the liquid to the first end of the second rising tube, wherein the first rising tube includes a first end and the second end, with the second end positioned at a higher elevation than the first end, and wherein the second rising tube includes a first end and the second end, with the second end positioned at a higher elevation than the first end.

15. The method of claim 14, further comprising increasing, by a blower provided in the second rising tube, a pressure differential between the evaporator and the condenser.

16. The method of claim 14, wherein the pump is configured to increase pressure of the liquid traveling upward within the first rising tube, and wherein heat provided to the evaporator changes a state of at least a part of the liquid to the vapor.

17. The method of claim 14, further comprising actively metering, by the pump, an amount of the liquid delivered to the evaporator.

18. The method of claim 14, wherein the condenser, the return tube, the first rising tube, the evaporator, and the second rising tube are connected in series to form a heat transfer path.

* * * * *